US006471180B1

(12) United States Patent
Cunningham

(10) Patent No.: US 6,471,180 B1
(45) Date of Patent: Oct. 29, 2002

(54) FREE STANDING STORAGE STAND FOR AN OUTDRIVE

(76) Inventor: Curt D. Cunningham, 1076 Howells Rd., Bay Shore, NY (US) 11706

( * ) Notice: Subject to any disclaimer, the term of this patent is extended or adjusted under 35 U.S.C. 154(b) by 246 days.

(21) Appl. No.: 09/713,286

(22) Filed: Jul. 5, 2000

(51) Int. Cl.[7] ..... F16M 13/00; F16M 1/00; F16M 3/00; F16M 5/00; F16M 11/32

(52) U.S. Cl. ..... 248/640; 248/440.1; 248/671; 248/676

(58) Field of Search ..... 248/640, 671, 248/676, 678, 163.1, 440.1, 346.01, 174; 211/40, 42, 41.12, 13.1

(56) References Cited

U.S. PATENT DOCUMENTS

| | | | | | |
|---|---|---|---|---|---|
| 2,646,237 | A | * | 7/1953 | Hinesman | 248/4 |
| 2,966,319 | A | * | 12/1960 | Todish | 248/13 |
| 4,044,978 | A | | 8/1977 | Williams | 248/13 |
| 4,108,425 | A | | 8/1978 | Crabtree | 269/71 |
| 4,570,960 | A | | 2/1986 | Peetz | 280/47.13 R |
| 4,674,967 | A | * | 6/1987 | Oseka | 425/110 |
| D302,619 | S | | 8/1989 | Catonzaro | D34/26 |
| 5,020,708 | A | | 6/1991 | Kalbach | 224/42.32 |
| 5,024,002 | A | * | 6/1991 | Possati | 33/549 |
| 5,566,960 | A | | 10/1996 | McCrory | 280/47.35 |
| 5,622,272 | A | * | 4/1997 | Orlando | 211/90 |
| 5,680,931 | A | | 10/1997 | Hoshimoto et al. | 206/319 |
| 6,364,277 | B1 | * | 4/2002 | Miller | 248/676 |

* cited by examiner

*Primary Examiner*—Leslie A. Braun
*Assistant Examiner*—Amy J. Sterling
(74) *Attorney, Agent, or Firm*—Richard L. Miller

(57) ABSTRACT

A free standing storage stand for an outdrive that includes a frame that rests on a horizontal surface and supports the outdrive in an upright position. The frame includes a front wall, a rear wall, and a pair of runners. The front wall has an uppermost edge that has a cutout that is symmetrical V-shaped and defined by a pair of edges, and an innermost surface. The rear wall has a lowermost edge that has a cutout that receives the skeg of the outdrive and an uppermost edge that has a cutout that is symmetrical V-shaped and defined by a pair of edges. Each runner extends from the innermost surface of the front wall, flush with associated edges of the cutout in the front wall, to the innermost surface of the rear wall, flush with aligned edges of the cutout in the rear wall, respectively. Each runner has a width that is less than the length of each edge of each cutout of each of the front wall and the rear wall, respectively, so as to provide a space between the pair of runners that allows the skeg of the outdrive to pass dependingly therethrough and into, and be captured by, the cutout in the lowermost edge of the rear wall, while the housing of the outdrive rests on the pair of runners.

4 Claims, 1 Drawing Sheet

FREE STANDING STORAGE STAND FOR AN OUTDRIVE

BACKGROUND OF THE INVENTION

1. Field of the Invention

The present invention relates to a free standing storage stand. More particularly, the present invention relates to a free standing storage stand for an outdrive.

2. Description of the Prior Art

Numerous innovations for outboard motor stands have been provided in the prior art that will be described. Even though these innovations may be suitable for the specific individual purposes to which they address, however, they differ from the present invention.

A FIRST EXAMPLE, U.S. Pat. No. Des. 302,619 to Catonzaro teaches the ornamental design for an outboard motor storage rack.

A SECOND EXAMPLE, U.S. Pat. No. 4,044,978 to Williams teaches a stand for supporting boat motors comprising a generally horizontally disposed base and a motor support means for supporting said boat motor on said base comprising connection means for connecting the stand to the cavitation plate of said boat motor on said each side of said motor and a support member extending between said base and said connection means.

A THIRD EXAMPLE, U.S. Pat. No. 4,108,425 to Crabtree teaches a repair stand for heavy objects such as outboard motors that has a base with a vertical standard. The standard has a vertically adjustable carrier tube with a horizontal cross rod on its upper end. A mounting plate is secured to the rod on arms with bearing whereby it is pivotal about the rod. A hydraulic cylinder with an extensible and retractable ram is positioned on the carrier tube and is connected, through a channel track And trolley, to the plate to effect controlled pivotal movement thereof.

A FOURTH EXAMPLE, U.S. Pat. No. 4,570,960 to Peetz teaches a cart that has a clamp securing it to the cavitation plate on the stem of the motor. The cart stands upright on two rear wheels and a front leg, allowing it to be tilted and wheeled up or down stairs. An arched frame partially surrounds and protects the propeller.

A FIFTH EXAMPLE, U.S. Pat. No. 5,020,708 to Kalbach teaches an outboard motor stand apparatus for use in a vehicle wherein the apparatus includes a mounting unit secured to the interior of a vehicle, a main support unit rotatably connected to the mounting unit and an auxiliary support unit pivotally secured to the main support unit. The auxiliary support unit is further provided with a hinged mounting block member adapted to be engaged by the engine mount of an outboard motor.

A SIXTH EXAMPLE, U.S. Pat. No. 5,566,960 to McCrory teaches a storage and carriage stand for an outboard motor. The stand has a wheeled base constructed of opposing elongate side portions and a transversely positioned interior end portion which extends between the side portions tubular steel members. The base members support a frame which includes opposed upright members which are interconnected by a transversely positioned and vertically disposed generally planar shaped transom, to which an outboard motor may be securely affixed. The transport stand base is generally U-shaped so as to include an open end, with the open end being of sufficient width to allow a selected outboard motor which is being attached to said stand to freely pass between said opposing elongate side portions until said transom is reached by the outboard motor.

A SEVENTH EXAMPLE, U.S. Pat. No. 5,680,931 to Hashimoto et al. teaches an outboard motor packing structure convertible to a display stand, having a rectangular parallelepiped formed with rod members, which rod members include first side rods on both right and left sides connecting the front and back rods, in which an end of each first side rod is detached from the front rods and connected to the bottom rods when the packing structure accommodating an outboard motor therein is converted to a display stand by disjointing parts of the rods, wherein the outboard motor is in the same position as when installed in a boat.

It is apparent that numerous innovations for outboard motor stands have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a free standing storage stand for an outdrive that avoids the disadvantages of the prior art.

ANOTHER OBJECT of the present invention is to provide a free standing storage stand for an outdrive that is simple and inexpensive to manufacture.

STILL ANOTHER OBJECT of the present invention is to provide a free standing storage stand for an outdrive that is simple to use.

BRIEFLY STATED, YET ANOTHER OBJECT of the present invention is to provide a free standing storage stand for an outdrive that includes a frame that rests on a horizontal surface and supports the outdrive in an upright position. The frame includes a front wall, a rear wall, and a pair of runners. The front wall has an uppermost edge that has a cutout that is symmetrical V-shaped and defined by a pair of edges, and an innermost surface. The rear wall has a lowermost edge that has a cutout that receives the skeg of the outdrive and an uppermost edge that has a cutout that is symmetrical V-shaped and defined by a pair of edges. Each runner extends from the innermost surface of the front wall, flush with associated edges of the cutout in the front wall, to the innermost surface of the rear wall, flush with aligned edges of the cutout in the rear wall, respectively. Each runner has a width that is less than the length of each edge of each cutout of each of the front wall and the rear wall, respectively, so as to provide a space between the pair of runners that allows the skeg of the outdrive to pass dependingly therethrough and into, and be captured by, the cutout in the lowermost edge of the rear wall, while the housing of the outdrive rests on the pair of runners.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 2:
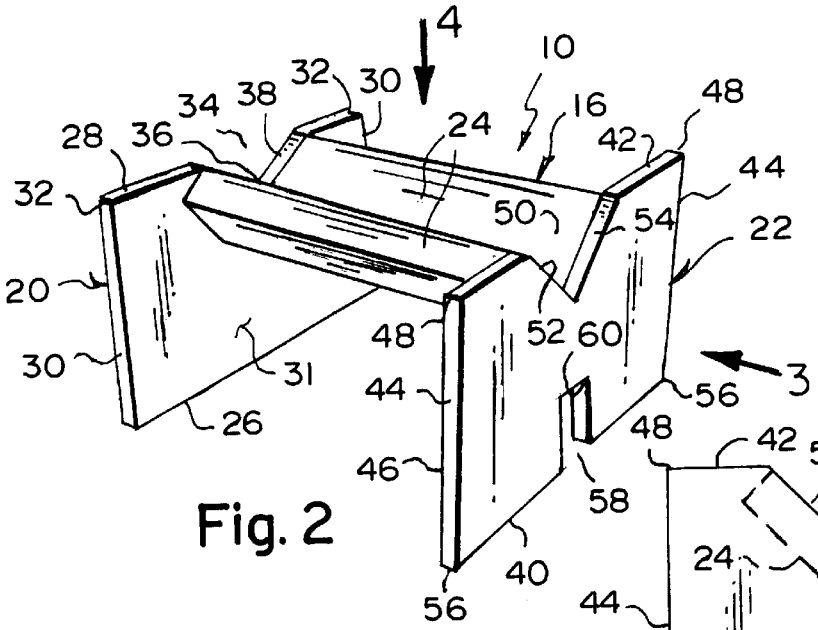
FIG. 2 is a diagrammatic perspective view of the present invention identified by arrow 2 in FIG. 1.
Figure 3:
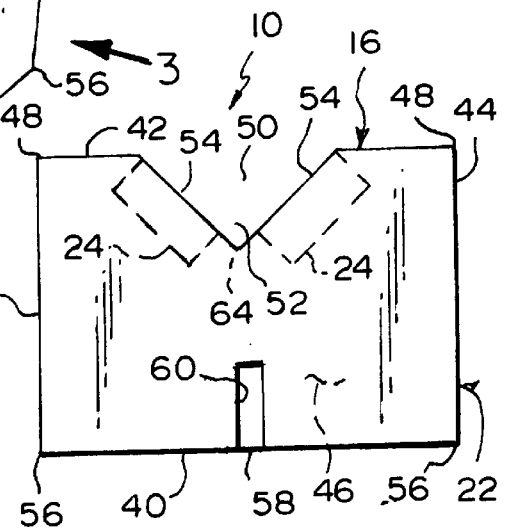
FIG. 3 is a diagrammatic elevational end view taken generally in the direction of arrow 3 in FIG. 2.

10 free standing storage stand of present invention for outdrive 12
12 outdrive
14 skeg of outdrive 12
15 housing of outdrive 12
16 frame for resting on horizontal surface 18 and for supporting outdrive 12 in upright position
17 plate
18 horizontal surface
20 front wall of frame 16
22 rear wall of frame 16
24 pair of runners of frame 16
26 lowermost edge of front wall 20 of frame 16 for resting on horizontal surface 18
28 uppermost edge of front wall 20 of frame 16
30 pair of side edges of front wall 20 of frame 16
31 innermost surface of front wall 20 of frame 16
32 pair of terminal ends of uppermost edge 28 of front wall 20 of frame 16
34 midpoint of uppermost edge 28 of front wall 20 of frame 16
36 cutout in midpoint 34 of uppermost edge 28 of front wall 20 of frame 16
38 pair of edges defining cutout 36 in midpoint 34 of uppermost edge 28 of front wall 20 of frame 16
40 lowermost edge of rear wall 22 of frame 16 for resting on horizontal surface 18
42 uppermost edge of rear wall 22 of frame 16
44 pair of side edges of rear wall 22 of frame 16
46 innermost surface of rear wall 22 of frame 16
48 pair of terminal ends of uppermost edge 42 of rear wall 22 of frame 16
50 midpoint of uppermost edge 42 of rear wall 22 of frame 16
52 cutout in midpoint 50 of uppermost edge 42 of rear wall 22 of frame 16
54 pair of edges defining cutout 52 in midpoint 50 of uppermost edge 42 of rear wall 22 of frame 16
56 pair of terminal ends of lowermost edge 40 of rear wall 22 of frame 16
58 midpoint of lowermost edge 40 of rear wall 22 of frame 16
60 cutout in lowermost edge 40 of rear wall 22 of frame 16 for receiving skeg 14 of outdrive 12
64 space between pair of runners 24 of frame 16 for allowing skeg 14 of outdrive 12 to pass dependingly therethrough and into, and be captured by, cutout 60 in lowermost edge 40 of the rear wall 22 of frame 16, while housing 15 rests on pair of runners 24 of frame 16

DETAILED DESCRIPTION OF THE PREFERRED EMBODIMENT

Figure 1:
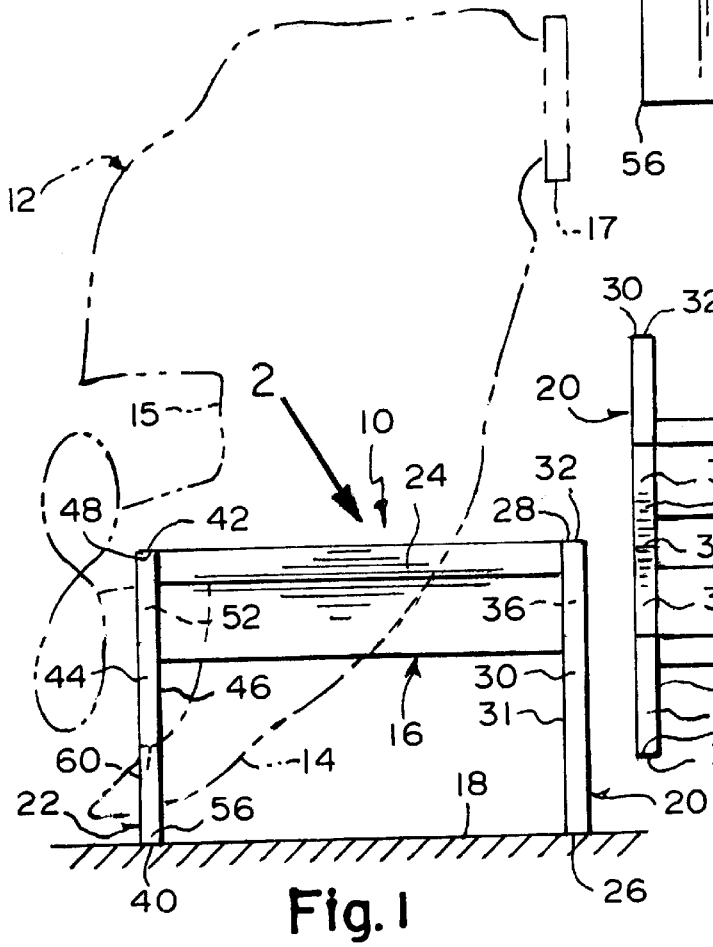
FIG. 1 is a diagrammatic side elevational view of the present invention in use supporting an outdrive with a skeg.
Figure 4:
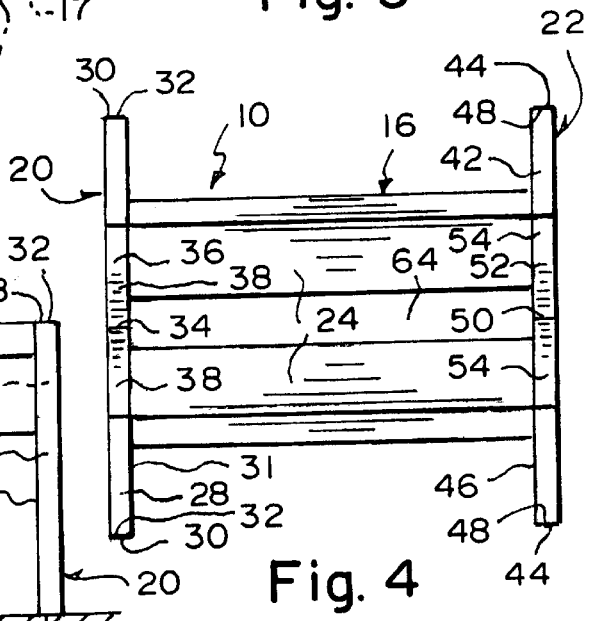
FIG. 4 is a diagrammatic top plan view taken generally in the direction of arrow 4 in FIG. 2.

Referring now to the figures, in which like numerals indicate like parts, and particularly to FIG. 1, the free standing storage stand of the present invention is shown generally at 10 for an outdrive 12, wherein the outdrive 12 has a skeg 14 and a housing 15 and replaceably mounts by a plate 17 to a transom (not shown) of a boat (not shown).

The configuration of the free standing storage stand 10 can best be seen in FIGS. 1–4, and as such, will be discussed with reference thereto.

The free standing storage stand 10 comprises a frame 16 for resting on a horizontal surface 18 and for supporting the outdrive 12 in an upright position.

The frame 16 comprises a front wall 20, a rear wall 22, and a pair of runners 24.

The front wall 20 is vertically-oriented and has a lowermost edge 26 that is straight and horizontally-oriented for resting on the horizontal surface 18, an uppermost edge 28 that is straight, horizontally-oriented, and disposed above, and parallel to, the lowermost edge 26 thereof, a pair of side edges 30 that are straight, vertically-oriented, parallel to each other, and extend from the uppermost edge 28 thereof to the lowermost edge 26 thereof, and an innermost surface 31.

The uppermost edge 28 of the front wall 20 has a pair of terminal ends 32 and a midpoint 34 that is midway between the pair of terminal ends 32 thereof.

The uppermost edge 28 of the front wall 20 further has a cutout 36 that is symmetrical V-shaped, depends from the midpoint 34 thereof, and is defined by a pair of edges 38 that have lengths.

The rear wall 22 is vertically-oriented, spaced parallel behind the front wall 20, and has a lowermost edge 40 that is straight, aligned with the lowermost edge 26 of the front wall 20, and horizontally-oriented for resting on the horizontal surface 18, an uppermost edge 42 that is straight, aligned with the uppermost edge 28 of the front wall 20, horizontally-oriented, and disposed above, and parallel to, the lowermost edge 40 thereof, a pair of side edges 44 that are straight, aligned with the pair of side edges 30 of the front wall 20, respectively, vertically-oriented, parallel to each other, and extend from the uppermost edge 42 thereof to the lowermost edge 40 thereof, and an innermost surface 46.

The uppermost edge 42 of the rear wall 22 has a pair of terminal ends 48 that are aligned with the pair of terminal ends 32 of the uppermost edge 28 of the front wall 20, respectively, and a midpoint 50 that is midway between the pair of terminal ends 40 thereof and aligned with the midpoint 34 of the uppermost edge 28 of the front wall 20.

The uppermost edge 42 of the rear wall 22 further has a cutout 52 that is symmetrical V-shaped, depends from the midpoint 50 thereof, and is defined by a pair of edges 54 that have lengths and are aligned with the pair of edges 38 of the cutout 36 in the front wall 20, respectively.

The lowermost edge 40 of the rear wall 22 has a pair of terminal ends 56 and a midpoint 58 that is midway between the pair of terminal ends 56 thereof.

The lowermost edge 40 of the rear wall 22 further has a 4 cutout 60 that is rectangular-shaped, and extends vertically upwardly from the midpoint 58 thereof, parallel to the pair of side edges 44 of the rear wall 22 for receiving the skeg 14 of the outdrive 12.

Each runner 24 is slender, elongated, rectangular-parallelepiped-shaped, parallel to each other, and horizontally-oriented for supporting the housing 15 of the outdrive 12.

Each runner 24 extends from the innermost surface 31 of the front wall 20, flush with associated edges 38 of the cutout 36 in the front wall 20, to the innermost surface 46 of the rear wall 22, flush with aligned edges 54 of the cutout 52 in the uppermost edge 42 of the rear wall 22, respectively.

Each runner 24 has a width that is less than the length of each edge 38, 54, of each cutout 36, 52 of each of the front wall 20 and the rear wall 22, respectively, so as to provide a space 64 between the pair of runners 24 for allowing the skeg 14 of the outdrive 12 to pass dependingly therethrough and into, and be captured by, the cutout 60 in the lowermost edge 40 of the rear wall 22, while the housing 15 rests on the pair of runners 24, wherein the cutout 60 in the lowermost edge 40 of the rear wall 22 prevents the skeg 14 of the outdrive 12 from escaping and causing the outdrive 12 to tilt forwardly and fall, while the weight of the housing 15 of the outdrive 12 prevents the free standing storage stand 10 from tilting forwardly, by virtue of the downward force exerted by the weight of the outdrive 12 being greater than the rotational force exerted by the skeg 12 of the outdrive 12.

It will be understood that each of the elements described above, or two or more together, may also find a useful application in other types of constructions differing from the types described above.

While the invention has been illustrated and described as embodied in a free standing storage stand for an outdrive, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A free standing storage stand for an outdrive, wherein the outdrive has a skeg and a housing and replaceably mounts by a plate to a transom of a boat, said stand comprising a frame for resting on a horizontal surface and for supporting the outdrive in an upright position, wherein said frame comprises:

a) a front wall, wherein said front wall is vertically-oriented and has:

i) a lowermost edge that is straight and horizontally-oriented for resting on the horizontal surface;

ii) an uppermost edge that is straight, horizontally-oriented, and disposed above, and parallel to, said lowermost edge thereof;

iii) a pair of side edges that are straight, vertically-oriented, parallel to each other, and extend from said uppermost edge thereof to said lowermost edge thereof; and iv) an innermost surface, wherein said uppermost edge of said front wall has:

A) a pair of terminal ends;

B) a midpoint that is midway between said pair of terminal ends thereof; and

C) a cutout that is symmetrical V-shaped, depends from said midpoint thereof, and is defined by a pair of edges that have lengths b) a rear wall, wherein said rear wall is vertically-oriented, spaced parallel behind said front wall, and has:

i) a lowermost edge that is straight, aligned with said lowermost edge of said front wall, and horizontally-oriented for resting on said horizontal surface;

ii) an uppermost edge that is straight, aligned with said uppermost edge of said front wall, horizontally-oriented, and disposed above, and parallel to, said lowermost edge thereof;

iii) a pair of side edges that are straight, aligned with said pair of side edges of said front wall, respectively, vertically-oriented, parallel to each other, and extend from said uppermost edge thereof to said lowermost edge thereof; and iv) an innermost surface, wherein said uppermost edge of said rear wall has:

A) a pair of terminal ends that are aligned with said pair of terminal ends of said uppermost edge of said front wall, respectively;

B) a midpoint that is midway between said pair of terminal ends thereof and aligned with said midpoint of said uppermost edge of said front wall; and C) a cutout that is symmetrical V-shaped, depends from said midpoint thereof, and is defined by a pair of edges that have lengths and are aligned with said pair of edges of said cutout in said front wall, respectively; and v) a lowermost edge of said rear wall has:

i) a pair of terminal ends; and ii) a midpoint that is midway between said pair of terminal ends thereof, wherein said lowermost edge of said rear wall further has a cutout that is rectangular-shaped, and extends vertically upwardly from said midpoint thereof, parallel to said pair of side edges of said rear wall for receiving the skeg of the outdrive.

2. The stand as defined in claim 1, wherein each runner is slender, elongated, rectangular-parallelepiped-shaped, parallel to each other, and horizontally-oriented for supporting the housing of the outdrive.

3. A free standing storage stand for an outdrive, wherein the outdrive has a skeg and a housing and replaceable mounts by a plate to a transom of a boat, said stand comprising a frame for resting on a horizontal surface and for supporting the outdrive in an upright position, wherein said frame comprises:

a) a front wall, wherein said front wall is vertically-oriented and has:

i) a lowermost edge that is straight and horizontally-oriented for resting on the horizontal surface;

ii) an uppermost edge that is straight, horizontally-oriented, and disposed above, and parallel to, said lowermost edge thereof;

iii) a pair of side edges that are straight, vertically-oriented, parallel to each other, and extend from said uppermost edge thereof to said lowermost edge thereof; and iv) an innermost surface, wherein said uppermost edge of said front wall has:

A) a pair of terminal ends;

B) a midpoint that is midway between said pair of terminal ends thereof; and

C) a cutout that is symmetrical V-shaped, depends from said midpoint thereof, and is defined by a pair of edges that have lengths b) a rear wall, wherein said rear wall is vertically-oriented, spaced parallel behind said front wall, and has:

i) a lowermost edge that is straight, aligned with said lowermost edge of said front wall, and horizontally-oriented for resting on said horizontal surface;

ii) an uppermost edge that is straight, aligned with said uppermost edge of said front wall, horizontally-oriented, and disposed above, and parallel to, said lowermost edge thereof;

iii) a pair of side edges that are straight, aligned with said pair of side edges of said front wall, respectively, vertically-oriented, parallel to each other, and extend from said uppermost edge thereof to said lowermost edge thereof; and iv) an innermost surface, wherein said uppermost edge of said rear wall has:

A) a pair of terminal ends that are aligned with said pair of terminal ends of said uppermost edge of said front wall, respectively;

B) a midpoint that is midway between said pair of terminal ends thereof and aligned with said midpoint of said uppermost edge of said front wall; and C) a cutout that is symmetrical V-shaped, depends from said midpoint thereof, and is defined by a pair of edges that have lengths and are aligned with said pair of edges of said cutout in said front wall, respectively; and c) a pair of runners wherein, each runner extends from said innermost surface of said front wall, flush with associated edges of said cutout in said front wall, to said innermost surface of said rear wall, flush with aligned edges of said cutout in said uppermost edge of said rear wall, respectively.

4. The stand as defined in claim 2, wherein each runner has a width that is less than said length of each edge of each cutout of each of said front wall and said rear wall, respectively, so as to provide a space between said pair of runners for allowing the skeg of the outdrive to pass dependingly therethrough and into, and be captured by, said cutout in said lowermost edge of said rear wall, while the housing of the outdrive rests on said pair of runners, wherein said cutout in said lowermost edge of said rear wall prevents the skeg of the outdrive from escaping and causing the outdrive to tilt forwardly and fall, while the weight of the housing of the outdrive prevents said free standing storage from tilting forwardly, by virtue of the downward force exerted by the weight of the outdrive being greater than the rotational force exerted by the skeg of the outdrive.

* * * * *